United States Patent [19]

Taddicken

[11] 4,050,392

[45] Sept. 27, 1977

[54] BUTTON SELECTOR FEED FOR A BUTTON SEWING MACHINE

[75] Inventor: Hermann Taddicken, Schwabisch Gmund, Germany

[73] Assignee: Eisele Apparate-und Geratebau GmbH, Germany

[21] Appl. No.: 707,506

[22] Filed: July 22, 1976

[30] Foreign Application Priority Data

Dec. 2, 1975 Germany ..... 7538335[U]

[51] Int. Cl.[2] ..... D05B 3/22

[52] U.S. Cl. ..... 112/113; 221/122

[58] Field of Search ..... 112/113, 106, 144, 104, 112/108, 110; 221/122, 133

[56] References Cited

U.S. PATENT DOCUMENTS

| | | | |
|---|---|---|---|
| 1,128,456 | 2/1915 | Kelly | 221/122 |
| 2,099,267 | 11/1937 | Hackett | 221/122 X |
| 3,095,085 | 6/1963 | Meijer | 221/122 X |
| 3,456,817 | 7/1969 | Irazoqui | 221/122 X |
| 3,575,316 | 4/1971 | Bianchi | 112/113 X |
| 3,931,775 | 1/1976 | Zaruba | 112/113 |

*Primary Examiner*—H. Hampton Hunter
*Attorney, Agent, or Firm*—McGlew and Tuttle

[57] ABSTRACT

A button selector feed for button sewing machines which has a button clamp plate with a button feed slot through which a driver is movable to advance a button into association with the sewing apparatus, comprises a button selector which is mounted on the clamp plate adjacent the feed slot. The button selector has a fixed part with a button delivery slot overlying the feed slot and a movable part which is movable relative to the feed part and which contains a plurality of button feed channels defined therein, each accommodating a stack or a supply of a button of a particular type. The movable part is movable, for example, rotatable, relative to the fixed part so as to position a selected one of the feed channels into alignment with the feed slot. The button feeding mechanism includes means for holding a button in a feed slot after it has been withdrawn from the button delivery slot until a driver which is mounted on a lever for movement therewith engages the button and advances it into association with the sewing needle.

4 Claims, 3 Drawing Figures

BUTTON SELECTOR FEED FOR A BUTTON SEWING MACHINE

FIELD AND BACKGROUND OF THE INVENTION

This ivention relates in general to the construction of sewing machines and, in particular, to a new and useful device for providing a selective feed of a selected one of a plurality of distinctive buttons into association with the sewing machine button advancing mechanism which positions the button in operative sewing position.

DESCRIPTION OF THE PRIOR ART

In a button sewing machine, it is necessary to feed a button into association with a feed advancing mechanism to position the button in alignment with the workpiece and the sewing needle. It is necessary for the operation of such machines that they be easily adaptable for use with buttons of different colors and sizes and which are normally contained in different storage receptacles. It is not unusual for such machines to have to switch over from the operation with one type of button to an operation with another type of button. In one known sewing machine button feeding device, there is a movable element which is displaced vertically to the fixed element and vertically in respect to the top side of the stack of operating buttons. Before the displacement, the button in the bottom removal slot must be removed from the displacement plane between the two elements. For this purpose, the known device includes a recoil mechanism which makes the selector very complicated in construction and subject to difficulties in operation.

SUMMARY OF THE INVENTION

The present invention provides a selector construction which makes it possible to shift from the feed of one type of button to the feed of another type of button without difficulty and which is of a simple construction and design. With the inventive device, the button which is eventually positioned in the displacement plane between the selector and the feeding device on the sewing machine is removed automatically from the contact region during the step up. In addition, the device includes a selctor having a plate or disc portion with a withdrawal slot which is alignable with a feed slot of the machine. The selector also includes a movable part, that is a part which is rotatable relative to the first part, and which includes a plurality of circumferentially spaced feed channels defined therethrough which are arranged at the same radial spacing from the center of rotation as the withdrawal slot, so that each may be aligned selectively with the withdrawal slot. The feed channels are adapted to contain a line of buttons which are arranged one adjacent the other and which feed horizontally through the withdrawal slot into association with the feed slot. The feed slot contains a holding mechanism which holds the first button in a position at which it clears withdrawal slot and in which it may be contacted by a driver mechanism of the machine to advance it into the sewing position. The remaining buttons are supported behind the button in the feed slot until this button is withdrawn by the driver so that the selector may be rotated without difficulty to position a new set of buttons behind the button which remains in the holding position until the driver removes it.

In a preferred embodiment of the invention, the selector includes a disc which is secured to a shaft member and which has an opening defining the withdrawal slot therein which is alignable with the feed slot of a clamping plate of the sewing machine to which it is affixed. The movable part of the selector comprises a pair of cylindrical plates which are journalled for rotation around the shaft and which contain a plurality of axially extending feed channels therein which may be selectively aligned with the withdrawal slot. The plate furthest from the disc includes a channel which is widened from the other one and which contains a coiled wire which is positioned on the ledges formed between the two feed channels of different dimensions and which defines a feed duct for the individual buttons which may be positioned in, or easily removed from the channel, as desired. The btton withdrawal slot defined on the fixed plate or disc is bevelled at least on each circumferential end in order to permit the last button in the feed channel which rests on a button contained by the driver to ride back past this fixed slot during the change in position of the selector plates to align a different feed channel behind the withdrawal slot.

Accordingly, it is an object of the invention to provide an improved selector mechanism for use with a sewing machine which has a button clamp plate with a feed slot therein for button and which includes a driver mechanism including a driver which moves into the feed slot for advancing a button out of the slot into association with a sewing mechanism and which comprises a button selector which is mounted on the plate and which includes a fixed part having a delivery slot adjacent the feed slot and a movable part which is movable relative to the fixed part which has a plurality of button feed channels defined therein for accommodating distinctive buttons in respective channels, and wherein, the movable part is mounted os as to permit its movement to present each channel selectively into alignment with the feed slot.

A further object of the invention is to provide a button selector feed for a button sewing machine which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference should be had to the accompanying drawing and descriptive matter in which there is illustrated a preferred embodiment of the invention.

DESCIPTION OF THE PREFERRED EMBODIMENT

Figure 1:
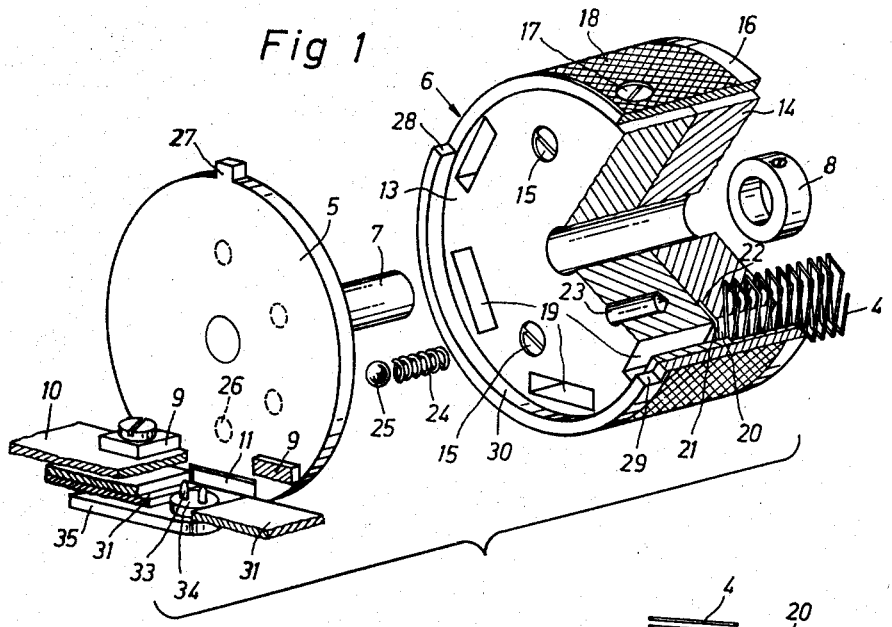
FIG. 1 is an exploded perspective view of a button selector mechanism shown in association with a sewing machine feed plate and constructed in accordance with the invention.

Referring to the drawing in particular, the invention embodied therein comprises a selector mechanism which is secured on a button clamp 1 of a sewing machine, which is only partly shown. The selector mechanism is usable with buttons 3 which are equipped with sewing holes 2 and which are fed automatically from button receptacles, which are not shown, through feed ducts 4 of the selector mechanism. Feed ducts 4 are defined by flexible wire spirals or coils which have a rectangular cross-section.

In accordance with the invention, the selector includes a fixed part in the form of a disc-shape element 5 having a button removal slot or withdrawal slot 11 and a movable part 6 in the form of a cylindrical element which is movable. that is, rotatable, relative to the fixed part 5. For this purpose, the fixed part includes a shaft 7 which is affixed to disc-shape element 5 which extends through a central journalled bore of the movable part. Movable part 6 is held in position by a ring 8 secured on a shaft 7. The selector mechanism is mounted on clamping plate 1 by lugs 9 which are secured on the outside of element 5 to a plate 10 of button clamp 1. In accordance with a feature of the invention, the lateral walls, or the walls extending in a circumferential direction 12, are inclined or bevelled so that the button removal slot 11 widens in the direction of the movable part 6.

Movable part 6 comprises two cylindrical plates 13 and 14 which are joined together by screws 15. A cylindrical ring 16 surrounds the two parts 13 and 14 and is secured thereto by a screw 17 on the part 13. The exterior surface of the ring 16 is roughened or provided with a knurling 18.

In accordance with a feature of the invention, part 14 is provided with four channels 19 which are arranged in the same relationship in respect to its radial spacing from shaft 7 as the button removal slot 11 and it has substantially the same cross-section. Part 14 includes additional passageways 20 which form continuations of the channels 19 but which have cross-sections which are increased relative to channels 19 in an amount sufficient to accommodate the flexible feed ducts 4 which are inserted into the passageways 20 and rest on the ledge formed between the two parts 13 and 14. The ends 21 of the wire spirals of feed ducts 4, which are inserted into passageways 20, are bent off and clamped in slots 22 of part 14, as indicated in FIG. 1.

Part 13 is provided with a bore 23 in which is inserted a compression spring 24 which presses a ball 25 against the inside of the element 5. Ball 25 is adapted to engage in one of four separate circumferentially spaced recesses 26 when movable part 6 is turned relative to the fixed part 5 and thus acts as a detent to position movable part 6 in the four operative positions indicated which provides alignment of the respective four slots 19 with the respective withdrawal slot 11. The amount of rotational movement of movable part 6 relative to fixed part 5 is controlled by engagement of a projection 27 on the ring 16 against respective end edges 28 and 29 of a built-up area or widening 30 of the ring 16 covering movable part 6.

Figure 2:
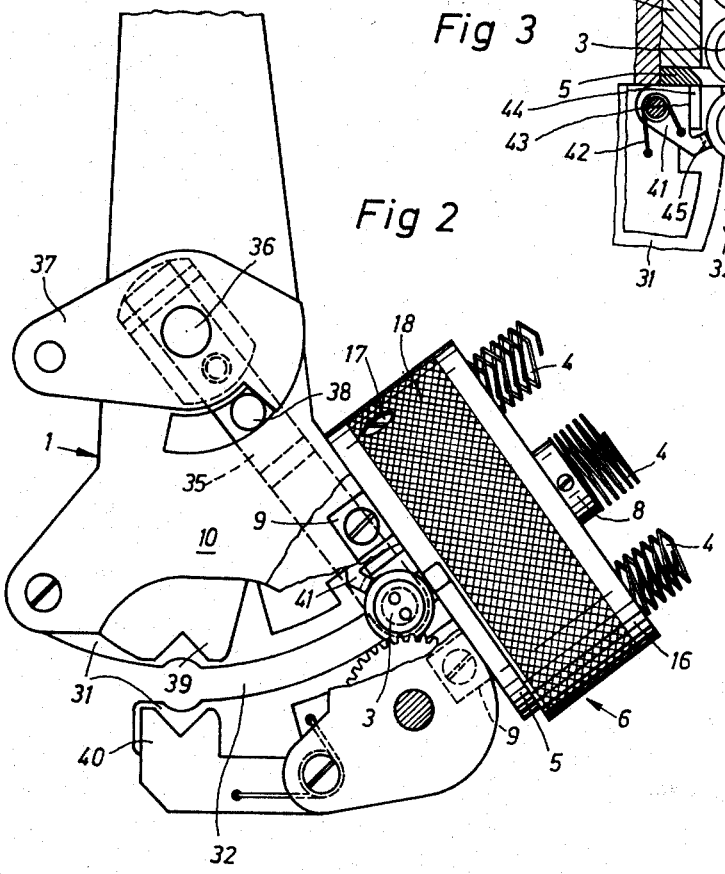
FIG. 2 is a top plan view of the selector mechanism installed on a feed plate.

The sewing machine includes a feed mechanism for the buttons which is carried on the button clamp 1 and includes a bottom plate 31 in which is provided an arcuated slot 32 which defines a feed slot for the movement of a driver 34 which is engageable with each button in succession to advance it along the slot. For this purpose, driver 34 is provided with spaced pins 33 which enter into button holes 2 and the driver is carried on a lever arm 35 which is pivoted on a journal 36 secured on button clamp 1. The lever arm is moved by a lever 37 which acts on a pin 38 secured on lever arm 35. Driver 34 can be turned from a standby position of button 3, as shown in FIG. 2, to a position located between retaining jaws 39 and 40 defined on clamp plate 1 on each side of the feed slot 32.

Figure 3:
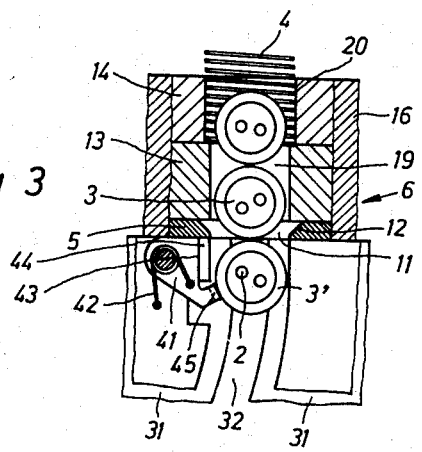
FIG. 3 is a partial horizontal sectional view through the removal slot of the selector mechanism shown in FIG. 2.

As shown in FIG. 3, a lever 41 is mounted on button clamp 1 and is pressed by a torsion spring 42 so that a stop surface 43 thereof bears against a shoulder 44 on plate 31. The lever carries a stopping clamp 45 which is positioned in the path of button 3 and holds a button 3' which has been withdrawn from the selector in a control position in the slot 32, thereby positioning the remaining buttons 3 beyond the end of the slot 32 with the forward edge aligned with the external face of the button removal slot 11. Buttons 3 slide in a known manner out of the button receptacles provided above the selector, down in succession into the flexible feed ducts 4. In the vicinity of the selector, the ducts 4 turn so as to be substantially horizontal, the first button in line being positioned in the plane of fixed element 5. Button 3' which is engaged by the stop cam 45 is held in this position until it is engaged by driver 34 whose pins move into the holes of button 3' and move the button to a location between jaws 39 and 40 of button clamp plate 1 during the rotation of lever 37. Button 3', during this movement, is guided on the lateral edges of plate 31 of the slot 32 and, when it is pulled by the driver, it deflects the lever 41 against the spring force 42 so as to permit withdrawal of button 3' through the slot and to permit the lateral movement of the next adjacent button in line. Thereupon, the following button becomes engaged by the stop cam 45 of lever 41, similar to the previous button. The operation is such that the withdrawn button is held outside the fixed plate 5 so that the movable part may be moved with the other button to arrange a new set of buttons therebehind, if desired. The advancement of the buttons is accomplished in a known manner by the pressure due to gravity of the buttons in the upper portions of duct 4.

In order to select the different type of button, the operator merely turns movable part 6 by hand about the shaft 7 to position a feed channel 19 having the buttons of the desired type with the removal slot 11 of the element 5. When part 6 is turned, one wall 12 of the button removal slot 11 bears on the outer circumference of button 3 arranged in alignment with the fixed part 5, as shown in FIG. 3, and continued rotation of the movable part pushes the button back into its receiving channel so that turning is easy. When a new channel is selected, the ball 25 locks into the recess 26 at the precise location of alignment of the next channel 19 with the withdrawal slot 11. This detent mechanism positions the aligned button feed channel so that it will not be displaced by accidental rotation. Stop surfaces 28 and 29 prevent excessive rotation of the element 6 in one or the other dirction and thus prevent excessive winding of the feeding ducts 4 which can remain connected at their upper or outer ends to the associated supply receptacle for the particular buttons with which they are associated.

While a specific embodiment of the invention has been shown and described in detail to illustrate the application of the principles of the invention, it will be understood that the invention may be embodied otherwise without departing from such principles.

What is claimed is:

1. A button selector feed for a button sewing machine having a button clamp plate with a feed slot and a driver having a button engagement means movable along the feed slot with a selected button, comprising a button selector mounted on the clamp plate adjacent the feed slot and having a fixed part with a button delivery slot adjacent the feed slot, and a movable part movable relative to said fixed part having a plurality of button feed channels defined therein and accommondating distinctive buttons in respective channels, and means mounting said movable part for movement relative to said fixed part so as to present each channel selectively into alignement with the delivery slot of the fixed part whereby the buttons in the aligned channels may be fed in succession from the associated aligned feed channel through said delivery slot and into the feed slot.

2. A button slector feed, according to claim 1, wherein said means mounting said removable part includes a support shaft on said fixed part said movable part being rotatably mounted on said support shaft, said feed channels being oriented at the same radial spacing from said shaft as said button delivery slot.

3. A button selector feed, according to claim 2, wherein said fixed part comprises a disc having said button delivery slot therein and including walls bounding each circumferetial side thereof being beveled in a direction away from said feed slot toward said movable part.

4. A button selector feed, according to claim 1, including a lever member pivotally mounted on said clamp plate and having a cam surface positionable in the feed slot and blocking a button which has been fed through said button delivery slot in a position immediately beyond said fixed part and supporting the remaining button therebehind in the associated feed channel, said movable part being rotatably mounted on said fixed part, the forwardmost button being positionable in a position with its forward edge located at the outer surface of said fixed part and the end edges of the slot of said fixed part being shaped to permit rotational movement of said movable part with the buttons and the inward guided movement of the forward most button force the remaining buttons backward during such movement, and means biasing said lever arm and said cam against said button and permitting withdrawal of said button by displacement of said lever against said biasing means.

* * * * *